United States Patent [19]

Calder

[11] Patent Number: 4,465,236

[45] Date of Patent: Aug. 14, 1984

[54] ADJUSTABLE SPRAY NOZZLE

[75] Inventor: Oliver J. Calder, Orange, Calif.

[73] Assignee: Phyllis Graham, Orange, Calif.

[21] Appl. No.: 404,369

[22] Filed: Aug. 2, 1982

[51] Int. Cl.[3] ..... B05B 1/30

[52] U.S. Cl. ..... 239/391; 239/455

[58] Field of Search ..... 239/451, 455, 456, 460, 239/505, 509, 512, 518, 521, 524, 390, 391

[56] References Cited

U.S. PATENT DOCUMENTS

| | | | |
|---|---|---|---|
| Re. 13,366 | 2/1912 | Bowers | 239/451 |
| 3,936,002 | 2/1976 | Geberth, Jr. | 239/455 |
| 4,126,272 | 11/1978 | Geberth, Jr. | 239/455 |
| 4,220,286 | 9/1980 | Geberth, Jr. | 239/455 |
| 4,269,355 | 5/1981 | Geberth, Jr. | 239/455 |

*Primary Examiner*—Andres Kashnikow

*Assistant Examiner*—Jon M. Rastello

*Attorney, Agent, or Firm*—Robert E. Strauss

[57] ABSTRACT

The invention is an adjustable spray nozzle useful in airless liquid spraying. The spray nozzle uses interchangeable spray orifice members which discharge against the beveled end of a cylindrical splash pin. The orifice member lines the cylindrical bore which receives the splash pin and the latter is axially adjustable in the spray nozzle body to permit an adjustably variable opening of the orifice, thereby permitting infinite adjustment of the volume of liquid and the area of the fan spray produced by the spray nozzle. The interchangeability of the orifice members provides a wide range of adjustability since interchangeable orifice members of varied orifice diameters can be readily substituted in the spray nozzle.

17 Claims, 3 Drawing Figures

FIG. 1
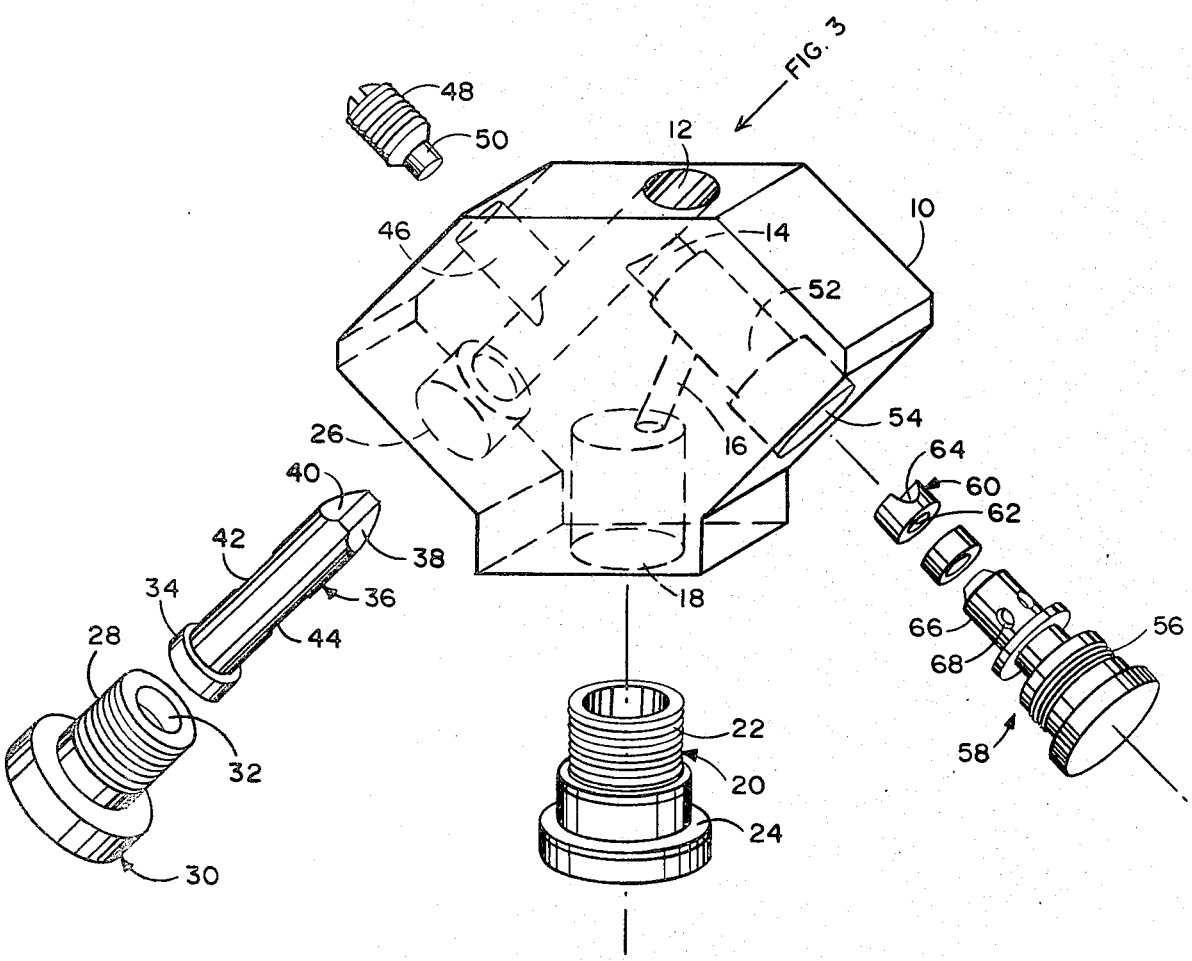
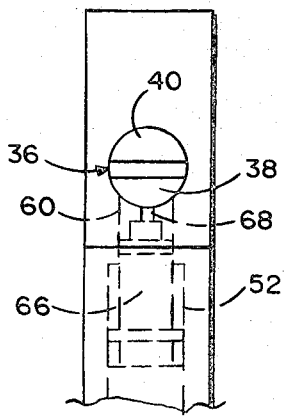
FIG. 3

ADJUSTABLE SPRAY NOZZLE

1. Field of Invention

This invention relates to a spray nozzle and, in particular, relates to an adjustable spray nozzle useful in airless spraying of liquids such as paint.

2. Brief Statement of the Prior Art

In airless spraying, liquid is discharged through orifices of minute diameters under very high pressures. The resultant spray has a characteristic fan shape to achieve uniform coating of the liquid, such as paint on a surface. A long felt need in this application is an adjustment capability whereby the volume of liquid discharge and the area of the fan spray can be adjusted at will by the operator. Presently, most applications require replacing the spray nozzle assembly or orifice member with one having a different orifice diameter and this interrupts and delays the spraying operation. Furthermore, only limited adjustment is achieved with interchangeable orifice members since the spray from each separate orifice member cannot be adjusted.

Some attempts have been made and in recent years to provide adjustable spray nozzles and these attempts have utilized quite complex mechanisms. One such attempt is disclosed in U.S. Pat. No. 3,414,196 in which several orifice members are permanently secured to a bar which is slideably mounted in the spray nozzle body to permit positioning any of the three orifice members into a spraying position. This attempt has not been successful commercially, partly because of great difficulties in sealing the slide bar sufficiently to prevent leakage under the high pressures encountered in airless spraying. Furthermore, the adjustment capability of this approach is still limited since there was no provision for adjustment of the spray from each individual spray member, but only provision for facilitating the interchange of differently sized orifice members.

Other approaches are shown in U.S. Pat. Nos. 3,936,002 and 4,126,272, both issued to John D. Geberth. The first of these patents shows a valve member in the form of a cylindrical rod which is moved along a slot in the cylindrical bore receiving the pin to uncover a variable area of the slot. This approach was acknowledged as unsatisfactory by the inventor in the latter of the two above-identified patents. In the latter patent, the patentee states that the difficulties experienced with the device of his former patent can be cured by positioning the pin at a 45 degree angle to the direction of the liquid discharged from the slot in the cylindrical wall. The resultant spray nozzle, however, still has disadvantages. The spray nozzle provides only a limited range of spray adjustment. The orifice members cannot be interchanged in the nozzle and, the adjustment is thus limited by the size of the orifice (slot) of each nozzle. The user must purchase several nozzle assemblies and replace these assemblies at a significant expense and time deiay, to obtain a wide range of adjustment. A relatively ancient patent, Bowers U.S. Pat. No. Re. 13,366 of 1912, (long before the advent of the liquid airless spraying), discloses the use of a flat slide plate having a beveled edge as a valve member to be moved over a orifice of spray nozzle. Despite its obvious simplicity, this approach has been disregarded in favor of the more complex mechanisms disclosed in the aforementioned recent patents. The approach shown in this ancient patent is not readily adaptable to airless spraying because it does not produce the desirable fan spray pattern necessary for airless spraying of paints.

BRIEF STATEMENT OF THE INVENTION

This invention comprises an adjustably variable high pressure spray nozzle having a body with mounting means to secure it to a spray gun and a fixedly adjustable spray discharge orifice valve member that permits a close control of the volume and the area of the resultant spray. The spray nozzle uses interchangeable orifice members, so orifice members of different diameter orifices can be interchanged in a rapid and facile manner. To this end, the body of the nozzle has a receptacle from the orifice member and locates the orifice member along a cylindrical bore that receives a cylindrical splash pin. The orifice member has a arcuately concave face, conforming to the contour of this cylindrical bore. The orifice spray member is secured in its receptacle by a removable plug. The cylindrical splash pin has a beveled end surface, which is positioned opposite the orifice of the orifice spray member, and is slideably mounted in the spray nozzle body so that it can be moved into a position covering or uncovering a variable area of the orifice whereby the volume and area of the resultant spray can be fixedly adjustable.

BRIEF DESCRIPTION OF THE DRAWINGS

The invention will be described with reference to the drawings of which:

FIG. 1 is an exploded perspective view of the spray nozzle of the invention;

FIG. 3 is a side view of the nozzle assembly.

DESCRIPTION OF PREFERRED EMBODIMENTS

Figure 2:
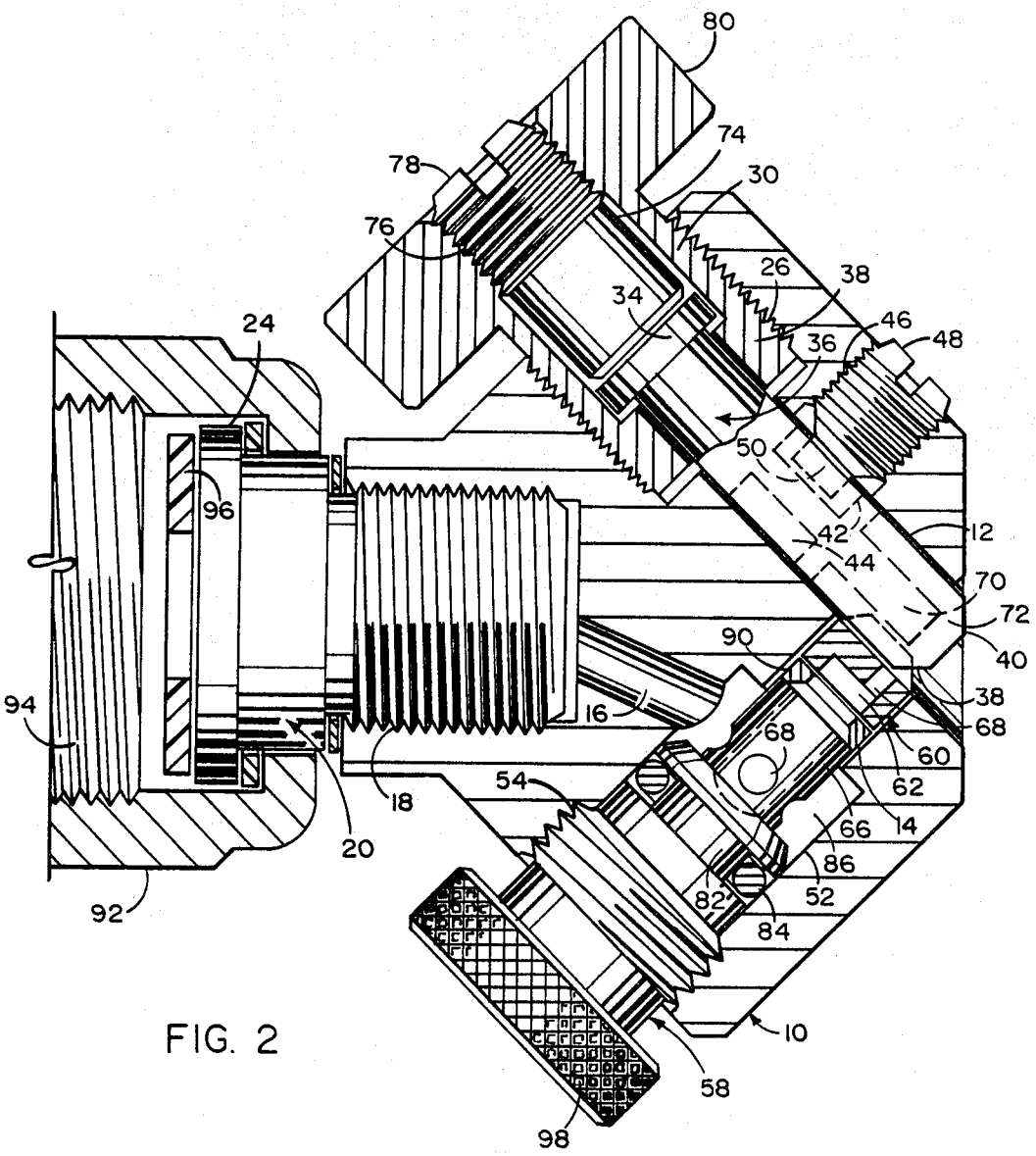
FIG. 2 is a elevational sectional view of the nozzle.

The invention comprises an adjustable spray nozzle having interchangeable, small diameter orifice members. As shown in FIG. 1, the spray nozzle has a body 10 which has a cylindrical through bore 12 and a cylindrical bore 14 positioned at right angles to, and intersecting, the cylindrical through bore 12. Body 10 also has an internal fluid passageway 16 which communicates between a intersecting cylindrical bore 18 and the cylindrical bore 14. Bore 18 extends partially into body 10 and is internally threaded to receive mounting sleeve 20 which has an externally threaded neck 22 and, at its opposite end, an annular flange 24 whereby the nozzle can be mounted and secured to a conventional spray gun by a retainer nut (not shown). The cylindrical partial bore 18 provides the fluid inlet port for the body 10.

The through bore 12 is counterbored at 26 and is internally threaded to receive the threaded neck 28 of a retainer sleeve 30. The retainer sleeve 30 has an inner annular lip 32 to capture the distal flange 34 of splash pin 36. Splash pin 36 is a cylindrical pin having beveled end surfaces 38 and 40, which are beveled at an angle from 25 degrees to 65 degrees, preferably at 45 degrees. The splash pin 36 is also provided with two axial grooves 42 and 44. Body 10 is also provided with a third bore 46 which extends from one edge surface thereof into intersection with the through bore 12 at an intermediate position along its length. Bore 46 is internally threaded to receive set screw 48 which has a distal neck 50. Neck 50 cooperates with either of the two axial grooves 42 and 44 of splash pin 40 to provide a key and keyway means whereby a predetermined angular orientation of the splash pin in bore 12 is maintained.

The bore 14 is counterbored at 52 and at 54 with successively greater diameter counterbores. Counterbore 54 is internally threaded to receive the externally threaded neck 56 of the orifice member retainer plug 58. Orifice member 60 is a generally cylindrical body having an arcuately concave discharge face 64, an inlet bore 62 on its opposite face which communicates with a small diameter orifice (not shown) in its discharge face. The arcuately concave face 64 has a radius of curvature equal to the radius of the through bore 12 whereby the orifice member 60 can be positioned at the intersection of the through bore 12 and bore 14, lining the through bore 12.

The orifice member retaining plug 58 has a reduced-diameter, hollow stem 66 with a plurality of apertures 68 communicating with the interior of stem 66.

The assembled nozzle is illustrated in FIG. 2. The splash pin 36 is positioned in the through bore 12 with one of its beveled end surfaces (38) positioned opposite the small diameter orifice 68 of the orifice member 60. The orifice member 60 is formed of a suitably hard, wear-resistant material such as tungsten carbide. Preferably, the end of splash pin 36 is also formed of a hard, wear-resistant material such as tungsten carbide and, for this purpose, the splash pin 36 has a reduced-diameter end portion 70 which receives a tungsten carbide sleeve 72 that is permanently affixed thereto. The tungsten carbide sleeve 72 has the aforementioned beveled end surfaces 38 and 40.

As shown in FIG. 2, the splash pin is captured with its distal flange 34 secured within the retainer sleeve 30 by the inner annular lip 38 of the sleeve.

The interior bore 74 of sleeve 30 is internally threaded at 76 to receive a set screw 78, thereby permitting fixed adjustability in the axial spacing of the splash pin 36 in the through bore 12. The retainer sleeve 30 is also provided with a knurled knob 80 for advancing and retracting the retainer sleeve 30 in its threaded engagement in the internally threaded counterbore 26.

As previously mentioned, the splash pin is provided with a keyway such as axial grooves 42 and 44. Set screw 48 is received in internally threaded bore 46 and neck 50 on the end of set screw 48 projects into one of either of these grooves 42 and 44, thus serving as a key and key way means to orient either of the beveled surfaces 38 and 40 to the orifice 68 of orifice member 60.

The orifice member 60 is secured by the retainer plug 58 which is threadably received in the internally threaded counterbore 54 of the bore 14. The retainer plug 58 is provided with an annular groove at 82 to receive O-ring 84, thus sealing the interior annular chamber 86 which is formed between the second counterbore 52 of bore 12 and the reduced-diameter, hollow stem 66 of the retainer plug 58. The stem 66 is open-ended, and discharges directly into the inlet bore 62 of the orifice member 60. The orifice member 60 is sealed in bore 14 by sealing washer.

The body 10 is secured to a conventional spray gun barrel by the retainer nut 92 which has internal threads 94 to be received over the threaded end of a spray gun barrel. An annular washer 96 of a material having low frictional characteristics, e.g. Teflon, Delrin, etc., is provided to seal between the end of the barrel of the spray gun (not shown) and the outer face of flange 24 of the sleeve 20. Sleeve 20 is threadably engaged in the internally threaded bore 18 of body 10 and the interior of this sleeve communicates with the fluid passageway 16 that extends between bore 18 and counterbore 52 of body 10.

Referring now to FIG. 3, there is illustrated a view in the direction indicated by arrowhead line 3—3' of FIG. 1. This view shows the splash pin 36 with its beveled end surfaces 40 and 38, and shows the small diameter orifice 68 of the orifice member 60 directed upwardly against the lower beveled end surface 38 of pin 36.

In operation, the spray nozzle assembly is secured to the discharge barrel of a conventional spray gun and the retainer nut 92 is tightened thereon to seal the assembly. Since seal washer 96 has a low coefficient of friction, the nozzle can be rotated to change the orientation of the fan spray to the spray gun without loosening retainer nut 92. The liquid under high pressure is discharged from the spray gun barrel through the retainer sleeve 20 and into the inlet port of passageway 16, through passageway 16 into the annular chamber 86 surrounding the hollow stem 66 of the retainer plug 58. The liquid enters the hollow stem 66 through apertures 68 and passes through the orifice spray member. The liquid is discharged as an atomized jet through the small diameter orifice 68. This jet impinges upon the beveled surface 38 of splash and is deflected from the open end of the through bore in a fan-shaped spray.

The volume of spray discharged and the area of the resultant fan-shaped spray is regulated by the fixed adjustability of the position of the splash pin 36 in the assembly. The retraction of the splash pin 36 opens the area of orifice 38, while the advance of the splash pin in the assembly closes or reduces the area of the orifice 68, directly controlling the volume of spray discharge from the assembly.

The orifice member 60 can be quickly interchanged with any of a plurality of orifice members having different diameter orifices 68, thereby greatly expanding the adjustable range of the nozzle. This can be accomplished without dismantling the spray nozzle assembly from the barrel of the spray gun or without disturbing the position of the splash pin. One need only remove the retainer plug 58 by grasping and turning knob 98. This permits removal of the retainer plug 58 and the spray orifice member 60. A substitute spray member having the same overall size and shape but, optionally, a different diameter orifice 68 can be readily placed in bore 14 and the retainer plug 58 can be returned, sealing the assembly. This entire replacement can be accomplished in a few minutes, independently of any adjustment of the splash pin and without removing the spray nozzle assembly from the barrel of the spray gun.

The invention has been described with reference to the illustrated and presently preferred embodiment. It is not intended that this invention of a specific preferred embodiment be unduly limiting of the invention. Instead, the invention is intended to be defined by the means, and their obvious equivalents, set forth in the following claims.

What is claimed is:

1. A spray assembly comprising:

(a) a body having a through bore and a partial bore intersecting said through bore adjacent one end thereof;

(b) fluid inlet port means and a fluid passageway in said body communicating between said inlet port means and said intersecting bore;

(c) spray gun attachment means operatively secured to said body to permit the discharge of fluid into said inlet port means;

(d) a cylindrical splash pin having a beveled end slideably inserted into said through bore and retaining means associated therewith for fixed adjustability of its position in said through bore, with its beveled end positioned at the intersection of said through bore and partial bore; and (e) an orifice spray nozzle member having an arcuately concave discharge face with a small diameter orifice received in said partial bore and secured at the intersection of said through bore and intersecting bore by orifice member retaining means also received in said partial bore.

2. The spray assembly of claim 1 wherein said through bore and partial bore are orthogonal.

3. The spray assembly of claim 1 wherein said partial bore is threaded and said orifice member retaining means is a retainer plug threadably engaged in said partial bore.

4. The spray assembly of claim 3 wherein said orifice member retainer plug has a reduced-diameter, apertured, hollow stem to form an annular chamber in said partial bore surrounding said stem and wherein said fluid passageway discharges into said annular chamber.

5. The spray assembly of claim 4 wherein said orifice member has a central passageway communicating with the hollow stem of said retainer plug.

6. The spray assembly of claim 4 including seal means to seal said annular chamber.

7. The spray assembly of claim 4 including first and second O-rings, one each at opposite ends of the reduced-diameter stem portion of said retaining plug.

8. The assembly of claim 1 wherein the beveled end surfaces of said splash pin are formed of a wear-resistant material.

9. The assembly of claim 1 wherein said splash pin has a reduced-diameter end and a cylindrical sleeve having a beveled end and formed of a wear-resistant material is received over and permanently affixed to said reduced-diameter end of said splash pin.

10. The assembly of claim 1 wherein said splash pin has a distal flange and said splash pin retaining means comprises an externally threaded retainer sleeve having an annular inner lip to slideably receive and capture said splash pin.

11. The assembly of claim 10 where said means to fixedly adjust the position of said splash pin in said through bore comprises a set screw threadably received in said retainer sleeve.

12. The assembly of claim 11 including key means in said body and cooperative groove means in said splash pin to orient the beveled end of said pin to the discharge orifice of said spray member.

13. The assembly of claim 1 wherein said spray gun attachment means comprises a retainer cap nut and a distally flanged sleeve captured therein with its opposite end threadably received in said body and in communication with said fluid inlet port means.

14. The assembly of claim 13 including a low-frictional-coefficient seal washer in said retainer cap nut to seal against the end of a spray gun while permitting rotation of said body.

15. In an adjustably variable high pressure spray nozzle having a body with mounting means to secure it to a spray gun and a fixedly adjustable spray discharge orifice valve member permitting a close control of the volume and the area of the resultant spray, the improvement permitting a wide range of adjustability which comprises:

a plurality of orifice spray members, each having a flow-limiting, small-diameter spray orifice, and receptacle means in said body for the removable reception of any one of said plurality of spray members; and orifice spray member retaining means removably secured in said body independently of said orifice valve member whereby orifice spray members can be interchanged to expand the range of variable adjustability of said spray head without removing said spray nozzle from the spray gun and without moving the position of said valve member.

16. The nozzle of claim 15 wherein said valve member is a cylindrical splash pin having a beveled end slideably inserted into a bore in said body with retaining means also in said bore for fixed adjustability of its position in said bore, with its beveled end positioned opposite the orifice of said spray member.

17. The nozzle of claim 16 wherein said orifice spray members have a concave cylindrical discharge face and said receptacle means is a bore intersecting said through bore and said spray members are secured at the intersection of said through and intersection bores by orifice member retaining means also received in said intersecting bore.

* * * * *